United States Patent [19]
Kosonocky et al.
[11] 4,167,905
[45] Sep. 18, 1979

[54] HAND GRENADE FUZE WITH SELF-INDUCED SPIN FOR ARMING

[75] Inventors: Stephan Kosonocky, Whippany; Sylvan H. Israels, Morris Plains, both of N.J.

[73] Assignee: The United States of America as represented by the Secretary of the Army, Washington, D.C.

[21] Appl. No.: 829,760

[22] Filed: Sep. 1, 1977

[51] Int. Cl.[2] ..... F42B 27/00; F42C 15/18

[52] U.S. Cl. ..... 102/64; 102/239; 102/244; 102/241

[58] Field of Search ..... 102/64, 239, 241, 244

[56] References Cited

U.S. PATENT DOCUMENTS

| | | | |
|---|---|---|---|
| 1,327,600 | 1/1920 | Lukens | 102/245 |
| 2,741,183 | 4/1956 | Graumann | 102/244 |
| 2,748,708 | 6/1956 | Bertram | 102/226 |
| 2,817,295 | 12/1957 | Wylie | 102/226 |
| 2,839,998 | 6/1958 | Rabinow | 102/226 |
| 3,580,177 | 5/1971 | Krahulec | 102/244 |
| 3,616,753 | 11/1971 | Carlson | 102/64 |
| 3,705,522 | 12/1972 | Lerman | 102/64 |

FOREIGN PATENT DOCUMENTS

| | | | |
|---|---|---|---|
| 260639 | 3/1912 | Fed. Rep. of Germany | 102/29 |

OTHER PUBLICATIONS

A.P.C. Application of H. Junghans, Ser. No. 387,324, published 5/4/43.

*Primary Examiner*—Samuel W. Engle
*Assistant Examiner*—Edward F. Miles
*Attorney, Agent, or Firm*—Nathan Edelberg; A. Victor Erkkila; Max Yarmovsky

[57] ABSTRACT

A hand grenade is provided with a fuze comprising: a firing means, means including two centrifugally-operated elements movably carried by the grenade housing for arming the firing means, means including an inertia member rotatable relative to the housing and a torsion spring between the inertia member and the housing for spinning the housing to operate the arming elements, and manually-held safety means for preventing arming until the grenade is thrown. Two disclosed embodiments have different arming and firing means with substantially the same spinning means.

15 Claims, 14 Drawing Figures

HAND GRENADE FUZE WITH SELF-INDUCED SPIN FOR ARMING

GOVERNMENT INTEREST

The invention described herein may be manufactured, used and licensed by or for the Government for Governmental purposes without the payment to us of any Royalty thereon.

BACKGROUND AND BRIEF SUMMARY OF THE INVENTION

The present invention relates to hand grenades and particularly to a new and improved grenade fuze with spin-operated firing means. A hand grenade is usually provided with a fuze including a booster charge for initiating the main charge, a detonator for initiating the booster charge, arming and firing means, a hand-held arm for preventing arming until the grenade is thrown, and a safety pin for locking the arm, until removed. Since the grenade is thrown, instead of being spin-launched from a rifled barrel like many explosive projectiles, one cannot utilize a safety or arming means operated by projectile spin resulting from external forces.

Brown et al, U.S. Pat. No., 2,872,866 and Kollmeyer, U.S. Pat. No. 2,991,717 each discloses a hand grenade having a fuze including a main housing containing an arming means and a torsion spring, 24 and 36, respectively, adapted, when released by the throwing of the grenade, to drive a rotary portion of the arming means to arm the grenade.

In accordance with the present invention, a hand grenade is provided with a fuze comprising a firing means, means including at least one centrifugally operated element movably carried by the grenade housing for arming the firing means, means carried by the housing for spinning the housing to operate the arming element, and manually held safety means for preventing such arming until the grenade is thrown. The means for spinning the housing comprises an inertia member, mounted on the housing for rotation relative thereto, and a torsion spring having one end attached to the inertia member and the other end detachably connected to the housing.

Two embodiments are disclosed herein having different arming and firing means but substantially the same spinning means. In one embodiment, the arming means comprises an elongated arming member mounted in a tubular support for rotation from a safe position to an intermediate position, from which it is longitudinally slidable to a final arming position. The first movement is produced by two opposed actuator plates which are operatively connected to the arming member to rotate the latter as the plates move outwardly during the spinning of the grenade, and the second movement is produced by a coil spring. In the other embodiment, an elongated arming member is longitudinally slidable in a tubular support from a safe position to an armed position. The arming member is locked in the safe position by two opposed pivoted detent arms or plates which engage locking shoulders on the arming member. As the detent arms move outwardly during the spinning of the grenade, the arming member is released and is moved by a coil spring to the armed position.

DETAILED DESCRIPTION OF PREFERRED EMBODIMENTS

Figure 2:
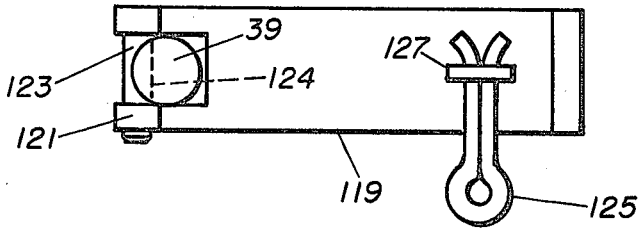
FIG. 2 is an end view, in the direction of the arrows 2—2 of FIG. 1, of a safety lock.
Figure 1:
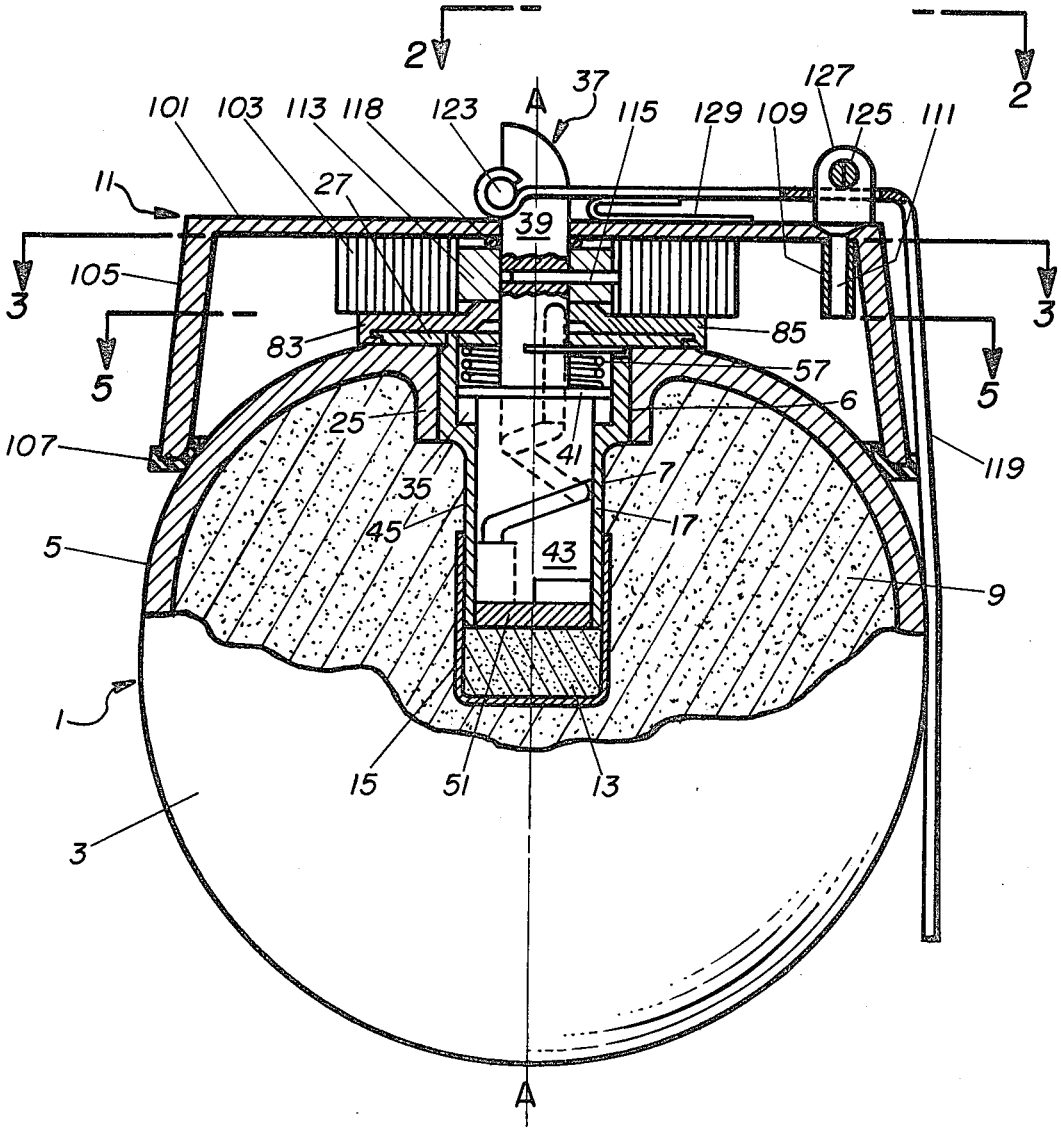
FIG. 1 is an axial section view, taken on line 1—1 of FIG. 3, of a grenade housing and fuze embodying the present invention.

FIGS. 1 through 11 illustrate the invention embodied, for example, in a hand grenade 1 comprising a metal housing or shell 3, having a surface of revolution 5 about an axis A—A, filled through an opening 6, except for an axial cavity 7, with a main charge 9 of high explosive material, such as composition B (60% RDX, 40% TNT). The cavity 7 may be molded or other wise formed in the charge 9.

The grenade 1 includes a fuze 11, for safely initiating this charge 9 after the grenade is thrown, comprising a booster charge 13 of intermediate explosive material, such as RDX; in a booster casing 15, disposed at the bottom of cavity 7. A tubular metal support 17 is mounted in cavity 7, with its inner end 19 adjacent to the booster charge 13 and an enlarged outer-end portion 21 secured, as by screw threads 23, within a flange 25 at opening 6. A rectangular support plate 27 is mounted on the outer end of tubular support 17, as by several teeth 29 (one shown) extending through apertures 31 (one shown) in plate 27, with a circular central opening 33 on the axis A—A. The enlarged end 21 of tubular support 17 is formed with an internal counterbore 35 which is coaxial with the opening 33 and the remaining inner surface of support 17.

Figure 8:
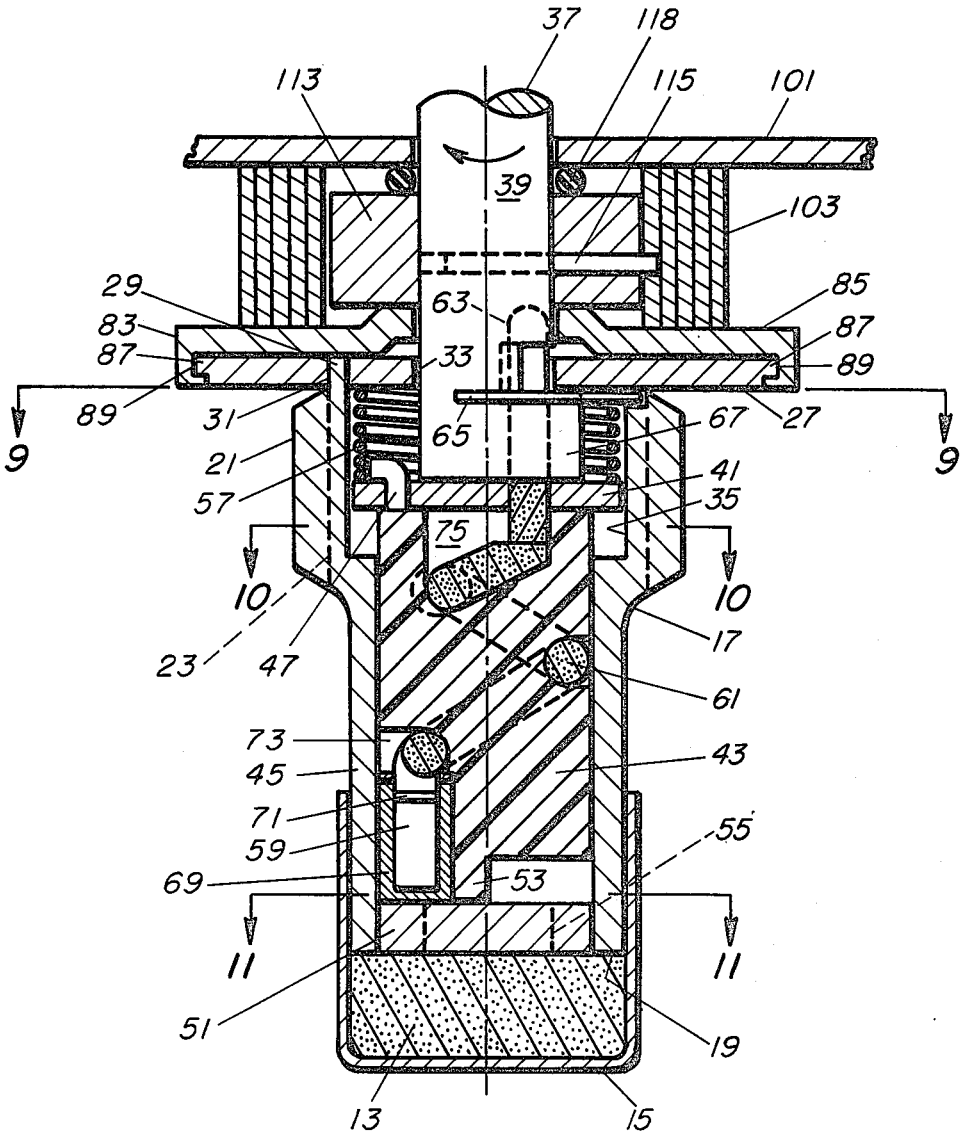
FIG. 8 is an enlarged axial section view, similar to FIG. 1, of the fuze therein.
Figure 9:
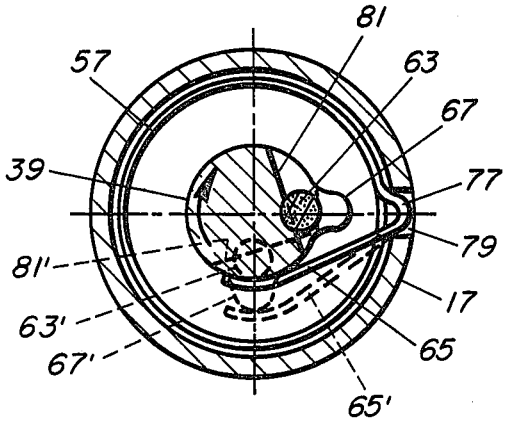
FIGS. 9, 10 and 11 are transverse section views taken on line 9—9, 10—10 and 11—11, respectively of FIG. 8.
Figure 10:
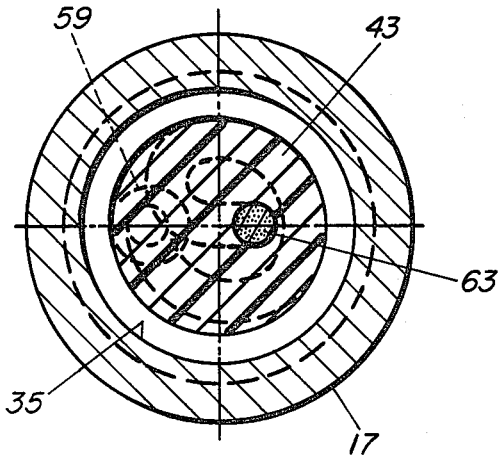

An elongated arming member 37 is mounted for limited rotary and longitudinal sliding motion in the tubular support 17 and plate 27, for arming the firing means. Member 37 is made up of an outer cylindrical shaft 39, a circular flange 41 on the shaft 39 and an inner cylindrical mandrel 43. The mandrel 37 is attached to the flange 41, as by bent-over tabs 47 and holes 49, one pair of which are shown in FIG. 8. In the safe position shown in FIGS. 1 and 8, the mandrel 37 is prevented from moving inwardly, toward the booster charge 13, by a safety plate 51 mounted in the end of portion 45, between the booster charge 13 and a reduced size mandrel extension 53 of sector-shaped cross-section (FIG. 11).

Figure 11:
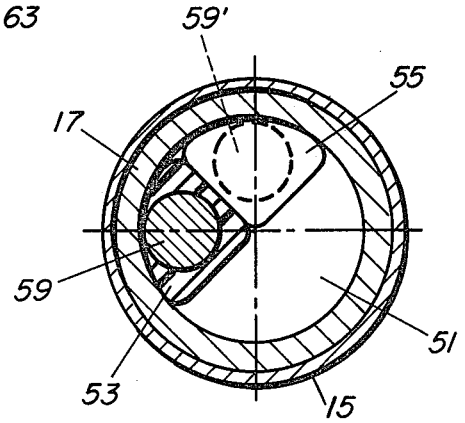

After the mandrel 37 has been rotated 90° clockwise, as seen in FIG. 11, the extension 53 is free to enter a similarly-shaped cut-out 55 in plate 51. Thus, the mandrel 37 is first rotated 90° from the safe position to an intermediate position and then slid inwardly to an armed position. The sliding motion is produced by a coil spring 57, interposed between plate 27 and flange 41.

The firing means of fuze 11, shown best in FIGS. 8–12, comprises the booster charge 13 and a firing train made up of a detonator 59, a pyrotechnic delay cord (PDC) 61, an explosive initiator or primer 63, a striker 65 and a cocking cam 67. The detonator 59, including a casing 69 and primer 71, is mounted in the inner end of the mandrel 43 and extension 53, adjacent to the booster charge 13 in armed position. The PDC 61 is a helical winding disposed in a helical groove 73 and an axial slot 75 formed in mandrel 43. The initiator 63 is mounted in and extends inwardly from the shaft 39 and flange 41, to the outer end of PDC 61. The striker 65 is an extended portion of the outermost turn of coil spring 57, having an elbow portion 77 extending into a slot 79 in tubular support 17 to prevent rotation of the spring. The cam 67 is a short longitudinal rib on the shaft 39. As the shaft rotates 90° clockwise, the cam 67 moves to the dotted position 67' in FIG. 9, camming the striker 65 outwardly to the dotted position 65' and moving the initiator 63 to the dotted position 63'. As the arming member 37 starts to move inwardly, the striker 65 slides off the cam rib 67 into a clearance notch 81 in the shaft 39 (dotted-position 81'), and strikes the initiator 63 which starts the firing train. The PDC 61 may be designed for any desired burning time, e.g., 3–4 seconds, so that the detonator 59 will be exploded a predetermined time after it is moved by the mandrel 37 to its armed position near the booster charge 13. Preferably the mandrel 43 is made of Teflon or similar material, to assure predictable PDC burning characteristics.

The arming means further comprises two centrifugally-operated inertia plates 83 and 85, slidably mounted on support plate 27, on opposite sides of shaft 39, by means of tongues 87 on plate 27 and grooves 89 on plates 83 and 85, for outward movement relative to shaft 39 when the grenade is spun. The inner ends 91 and 93 of plates 83 and 85 are cut-away to provide notches 95, for receiving the shaft 39, and lateral projections 97. The projections 97 extend into V-notches 99 in shaft 39 for rotating the latter, 90° clockwise in FIG. 5, when the plates 83 and 85 move outwardly by centrifugal force.

Figure 3:
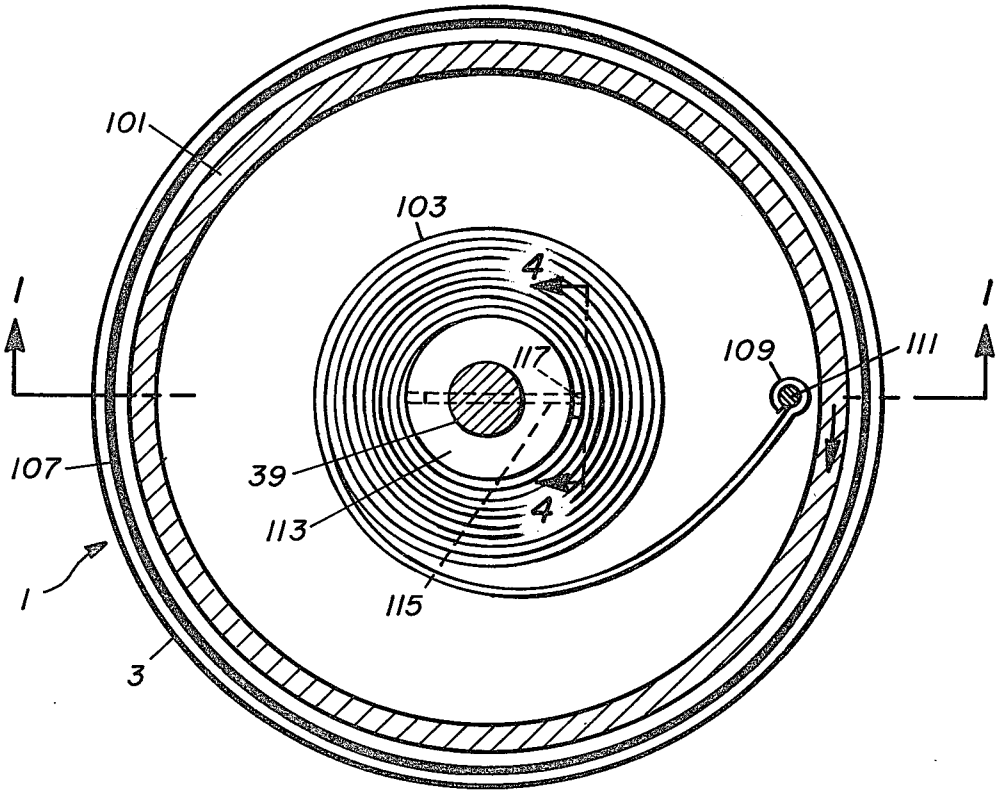
FIG. 3 is a transverse section view taken on line 3—3 of FIG. 1.

The grenade is spun by an inertia rotor 101 rotatably mounted on the arming shaft 39 and a multi-turn torsion spring 103 connected between the rotor 101 and the shaft 39. Rotor 101 is a shallow cup-shaped member having an outwardly tapered side wall 105 extending toward the grenade housing and capped by a rubber ring 107 of channel cross-section. Ring 107 not only seals the fuze from the entry of dust but also frictionally engages the housing 5 providing some resistance to relative rotation of the rotor and housing. The side wall 105 of the rotor, when present, also prevents rotation of shaft 39 by engaging the rounded outer ends of actuator plates 83 and 85 through the linkage with the shaft (see FIG. 5). Before the rotor 101 is assembled on the shaft 39, the untensioned spring 103 is inserted with the rotor, a loop 109 on the outer end of the spring is slipped over a pin 111 mounted in the rotor, the inner coil of the spring is slipped over an annular arbor bushing 113 attached to shaft 39 by a pin 115, and a v-slot 117 near the inner end of the spring is engaged with an outwardly-projecting end of pin 115. A rubber O-ring 118 is disposed around the shaft 39 between the rotor 101 and the bushing 113. The spring 103 is arranged to be tensioned by manually turning the rotor 101 counter clockwise as seen in FIG. 3 relative to the housing 3, after the rotor is fully assembled to the shaft 39 and housing 3.

After tensioning of the spring 103, the rotor 101 is locked to the shaft 39 by a safety means comprising a conventional L-shaped locking arm or spoon 119 comprising a notched end 121 receiving the shaft 39 and having a transverse pin 123 disposed in a transverse groove 124 in the shaft. The arm 119 is held in its locked position by a transverse cotter key or pin 125 removably mounted in a clevis 127 attached to rotor 101. A folded leaf spring 129 is compressed between the arm 119 and rotor 101, to remove the arm after the key 125 is removed.

The grenade 1 is thrown toward an enemy position, in the usual manner, wherein the locking key 125 is removed while manually holding the arm 119 against the housing 3. After the grenade is thrown, the arm 119 is immediately removed from the fuze, permitting the rotor 101 to rotate with respect to the shaft 39. The tension of spring 103 then begins to rotate the rotor 101, clockwise in FIGS. 3 and 5, relative to the rest of the grenade.

Figure 5:
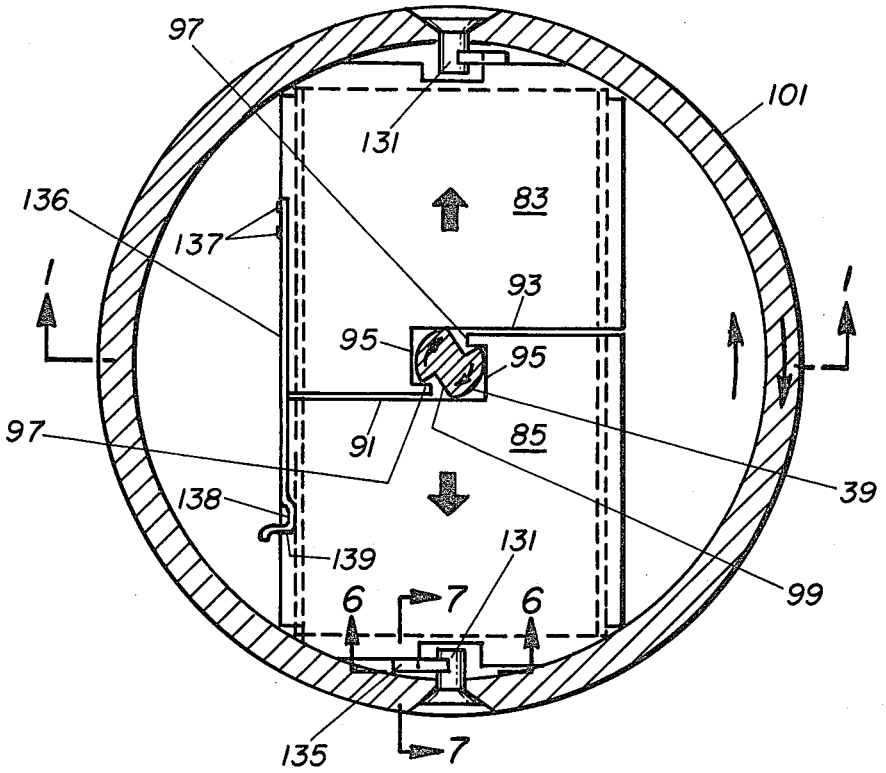
FIG. 5 is a transverse section view taken on line 5—5 of FIG. 1.
Figure 6:
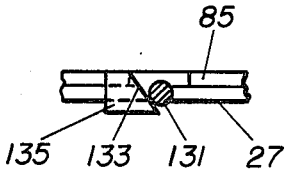
FIG. 6 is a view, partly in section, taken on line 6—6 of FIG. 5.
Figure 7:
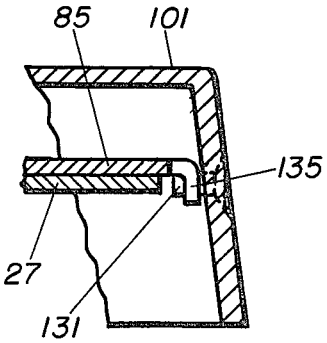
FIG. 7 is a section-view taken on line 7—7 of FIG. 5.

At least one, and preferably two, cam means is provided for moving the rotor 101 away from the housing 3 and plates 83 and 85 near the beginning of this rotation. This means comprises an inwardly-extending pin 131 carried by the rotor 101 and an inclined surface 133 on a lug 135 on the outer end of actuator plate 85, as shown in FIG. 5–7. When the rotor 101 turns, the pin 131 rides up the surface 133, lifting the rotor away from the housing 39. After the pin 131 clears the surface 133, the spring 103 spins the rotor 101 up to high angular velocity. In reaction to this spinning of the rotor, the spring also causes the rest of the grenade to spin in the opposite direction, at a lower angular velocity determined by the relative inertial masses and effective radii. This reverse spinning of the grenade housing 3 causes the actuator plates 83 and 85 to move outward by centrifugal force, rotating the arming member 37 to its intermediate position, from which it is slid, by spring 57, to the final armed position. When the spring becomes unwound, the V slot 117 automatically disengages from the pin 115, and the rotor 101 and spring 103 are discarded, prior to initiation of the main charge 9.

In addition to the restraint provided by the rotor 101, the two actuator plates 83 and 85 may be releasably held in their inner positions by a leaf spring 137 attached at 138 to one side edge of plate 83 and having a rounded detent 138 releaseably seated in a screw 139 in the side edge of plate 85.

Figure 13:
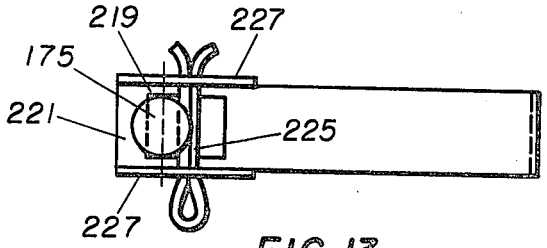
FIG. 13, is an end view, in the direction of the arrows 13—13 of FIG. 12, of the safety lock therein.
Figure 12:
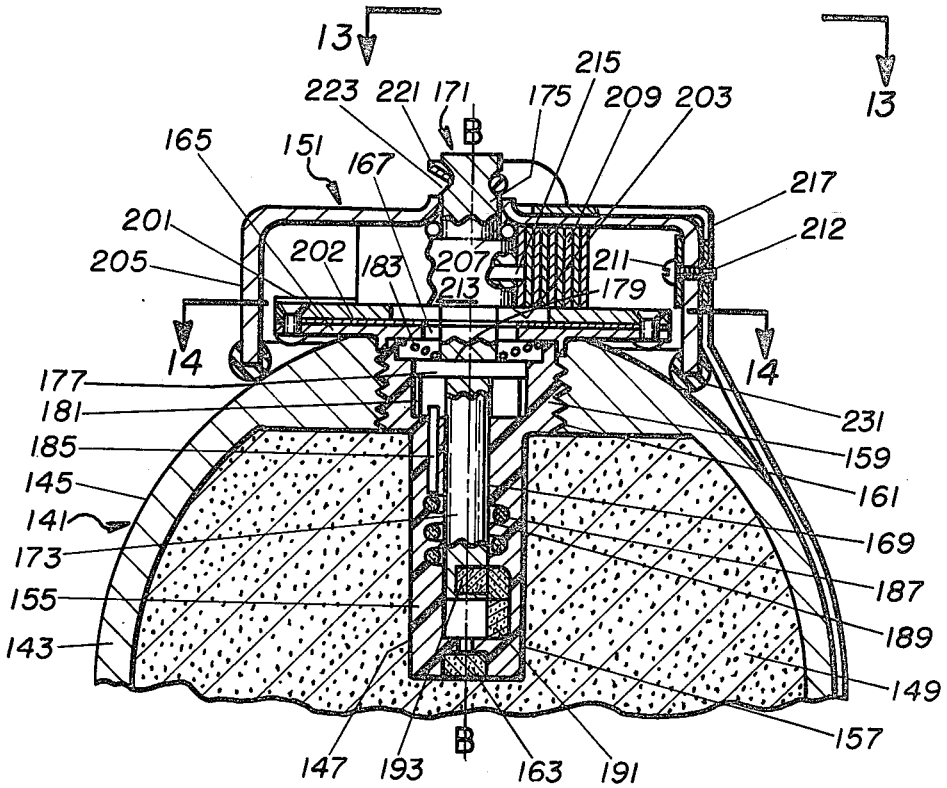
FIG. 12 is an axial section view, taken on line 12—12 of FIG. 14, of a grenade housing and fuze constituting a second embodiment of the invention.
Figure 14:
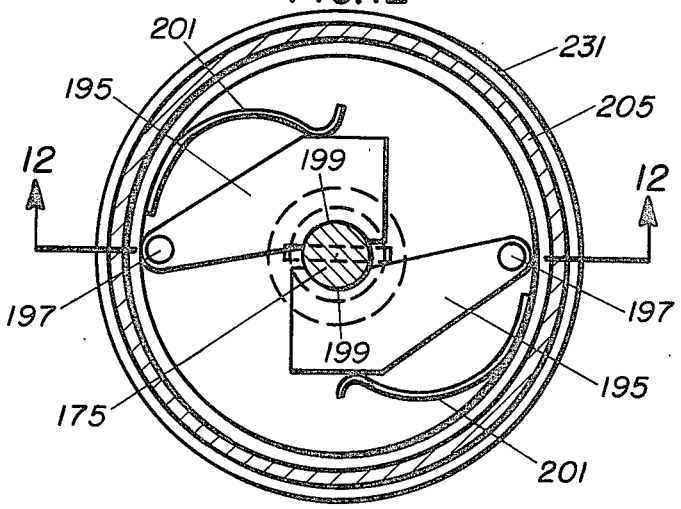
FIG. 14 is a transverse section view taken on line 14—14 of FIG. 12.

FIGS. 12 to 14 illustrate another embodiment of the invention in a grenade 141 comprising a metal housing or shell 143, having a surface of revolution 145 about an axis B—B, filled, except for an axial cavity 147, with a main high explosive charge 149. The grenade includes a fuze 151 for safely initiating the charge 149.

Fuze 151 comprises a tubular support 155, preferably of Teflon, comprising a cylindrical portion 157 disposed in cavity 147 and an enlarged portion 159 threaded into an axial opening 161 in housing 143. A booster charge 163 is mounted in the inner end of support 147, for initiating the main charge 149. A transverse circular support plate 165 is attached by suitable means to the outer end of tubular support 155, with a central opening 167 axially aligned, on axis B—B, with the inner surface 169 of tubular support portion 155 and an outer shaft portion 175. A transverse pin 177, mounted in a hole 179 in the arming member, rides in two opposed longitudinal grooves 181 in portion 159 to prevent rotation of the member 171. The arming member 171 is resiliently biased inwardly from the safe position shown to an inner armed position, by a coil spring 183 interposed between plate 165 and pin 177.

The firing means of fuze 151 comprises an impact-sensitive initiator or primer 185 recessed in the support 155 and adapted to be struck by the pin 177 on the inward movement of arming member 171, a helical PDC winding 187 disposed in an internal helical groove 189 in support 155, a detonator 191 recessed into support 155 at the inner end of winding 187, and an explosive relay 193 recessed into the inner end of arming member 171, which initiates the main charge 149 after the delay due to the PDC winding 187.

The arming means further includes a pair of opposed centrifugallyoperated detent arms or plates 195 pivotally mounted on one end on support plate 165, as by rivets 197. The sides of the detent plates 195, near the other end thereof, are provided with circulate cut outs 199 adapted to engage the cylindrical surface of shaft 175. The arms 195 are resiliently biased by two leaf spring arms 201 on a base plate 202 sandwiched between the plate 165 and the two detent plates 195, toward locking position in contact with shaft 175 beneath an annular shoulder 203 thereon.

Figure 4:
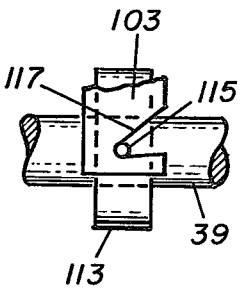
FIG. 4 is a fragmentary view, in the direction of the arrows 4—4 of FIG. 3, omitting nearly all of the torsion spring therein.

The grenade housing is spun, to operate the centrifugal detent arms 195, by a cup-shaped inertia rotor 205, rotatably mounted on shaft 175 by a central hole 207, and a torsion spring 209, having its outer end attached, as by a screw 211, to the rotor 205, and its inner end surrounding an arbor bushing 213 and releasably attached to the shaft 175 by a transverse pin 215, as in FIG. 4. The torsion spring 209 is given an initial axial deformation, to provide a small outward force on the rotor 205.

Initially, rotation of the rotor 205 with respect to the shaft 175 is prevented by a safety means comprising a manually held L-shaped arm or spoon 217 having an inclined slotted end 219 which fits over the shaft 175, with a cross-piece 221 engaged in a transverse notch 223 in the shaft. The arm 217 is locked to the rotor 205 by a safety cotter key 225 removably held in a pair of holes in side wings 227 and engaged in a second notch 229 in shaft 175. The rotor 205 is locked to the arm 217 by a tapered end 212 of the screw 211 extending through a hole in the arm. A rubber friction and seal ring 231 is mounted on the edge of the cup-shaped rotor as in FIG. 12.

After the key 225 is removed and the arm 217 is manually released on throwing the grenade, the outward thrust of the rotor spring 209 ejects the arm 217, with the arm 217 slipping off the tapered end 212 of screw 211, and the rotor 205 starts to rotate, retarded at first by friction between the rubber ring 231 and the surface 145. As the rotor 205 spins up, the rotor 205 is biased outwardly by the spring 209. Meanwhile, the grenade housing 143, by reaction, is spun in the opposite direction causing the inertia arms 195 to move outward by centrifugal force, thereby releasing the arming member 171 to be moved by spring 183 to armed position and starting the firing cycle.

We claim:

1. A hand grenade including a hollow housing, a high explosive main charge in said housing, and fuze means carried by said housing for initiating said main charge after the grenade has been thrown; said fuze means comprising:

firing means adapted, when actuated, to explode said charge;

means for arming said firing means after the grenade is thrown comprising:

an arming member movable in said housing from a safe position to an armed position;

at least one centrifugally-operated inertia element movably carried by said housing and operatively associated with said arming member;

means movably carried by said housing for spinning said housing to operate said element; which includes:

an inertia member rotatably carried by said housing; and a torsion spring connected between said housing and said inertia member, for spinning said housing and said inertia member in opposite directions; and manually releasable means for preventing actuation of said arming means until the grenade is thrown.

2. A hand grenade as in claim 1, wherein:

said fuze means comprises a tubular support attached to and extending into said housing;

said arming member is rotatable in said support from said safe position, wherein it is prevented from longitudinal movement, to an intermediate position, wherein it is longitudinally movable to said armed position;

said arming means comprises: two centrifugally-operated actuator elements mounted on opposite sides of said support to move outward by centrifugal force and operative to rotate said arming member from said safe position to said intermediate position; and resilient means biasing said arming member from said intermediate position.

3. A hand grenade as in claim 2, wherein:

said firing means comprises a booster charge at the inner end of said support and adjacent to said main charge;

said arming means comprises a spacer plate between said booster charge and said arming member and having a cut-out; and said arming member includes a reduced end portion that engages the solid portion of said plate in said safe position and enters said cut-out in said armed position.

4. A hand grenade as in claim 2, wherein said firing means further comprises:

a detonator in the inner end of said arming member;

an impact-sensitive initiator in said arming member, spaced from said detonator; and a spiral combustible delay cord in said arming member, connecting said initiator and said detonator; and striker means, actuated by the movement of said arming member from said intermediate position, for exploding said initiator.

5. A hand grenade as in claim 4, wherein said striker means comprises a spring-biased striker cocked by a longitudinal rib on said arming member during rotation thereof, and a clearance slot in said arming member and rib adjacent to said initiator.

6. A hand grenade as in claim 2, wherein:

said fuze means further comprises a flat support plate attached to the outer end of said support;

said arming member extends through said plate; and said actuator elements are plates slidably mounted on said plate and include projections extending into notches in said arming member for rotating the latter during spin.

7. A hand grenade as in claim 6, wherein:

said arming member includes an annular flange spaced inwardly from said support plate; and said resilient means comprises a coil spring interposed between said flange and said support plate.

8. A hand grenade as in claim 6, wherein said means for spinning said housing comprises:

an inertia member rotatably mounted on said arming member beyond said actuator plates; and a torsion spring connected between said arming member and said inertia member, for spinning said housing and said inertia member in opposite directions.

9. A hand grenade as in claim 8, wherein the connection between said spring and said arming member comprises a pin extending outwardly from said arming member, and a V-slot in one edge of said spring into which said pin extends, whereby said spring automatically disengages itself from said arming member when it becomes fully expanded, and said inertia member and spring are discarded.

10. A hand grenade as in claim 8, wherein said manually-held means comprises means for locking said inertia member and said arming member against relative rotation until said grenade is thrown.

11. A hand grenade as in claim 10, wherein said fuze means further comprises manually-releasable safety means for locking said manually-held means until released.

12. A hand grenade as in claim 8, wherein:

said inertia member is a cut-shaped member containing said torsion spring and having its open end initially engaging said housing; and said fuze means further comprises cam means for moving said open end away from said housing when said inertia member begins to rotate relative to said housing.

13. A hand grenade as in claim 12, wherein said cam means comprises at least one inclined cam surface carried by said housing and at least one pin carried by said cup-shaped member.

14. A hand grenade as in claim 12, wherein said firing means futher comprises:

a booster charge at the inner end of said tubular support and adjacent to said main charge;

an explosive relay in the inner end of said arming member;

a detonator in said tubular support adjacent to said relay when said arming member is in said armed position;

an impact-sensitive initiator in said support, spaced from said detonator;

a helical combustable delay cord in said tubular support connecting said initiator to said detonator; and striker means, actuated by the movement of said arming member toward said armed position, for exploding said initiator.

15. A hand grenade as in claim 14, wherein said striker means comprises:

a projection on said arming member adapted to strike said initiator.

* * * * *